United States Patent [19]

Ishiyama

[11] Patent Number: 5,034,973

[45] Date of Patent: Jul. 23, 1991

[54] X-RAY GENERATOR COMPRISING SWITCHING VOLTAGE REGULATOR TO REDUCE HARMONIC CURRENT COMPONENTS FOR SUPPLYING CONSTANT POWER

[75] Inventor: Fumio Ishiyama, Tochigi, Japan

[73] Assignee: Kabushiki Kaisha Toshiba, Kawasaki, Japan

[21] Appl. No.: 466,595

[22] Filed: Jan. 17, 1990

[30] Foreign Application Priority Data

Jan. 19, 1989 [JP] Japan ..... 1-10182

[51] Int. Cl.[5] ..... H05G 1/56

[52] U.S. Cl. ..... 378/114; 378/105; 378/107; 363/16

[58] Field of Search ..... 363/16; 378/99, 114, 378/101, 104, 107, 106, 118

[56] References Cited

U.S. PATENT DOCUMENTS

| | | | |
|---|---|---|---|
| 4,097,863 | 6/1978 | Chambers | 363/16 |
| 4,418,421 | 11/1983 | Kitadata et al. . | |
| 4,575,752 | 3/1986 | Honda et al. . | |
| 4,628,355 | 12/1986 | Ogawa et al. . | |
| 4,653,082 | 3/1987 | Tsuchiya | 378/101 |
| 4,734,924 | 3/1988 | Yahata et al. | 378/114 |
| 4,783,795 | 1/1988 | Yahata | 378/114 |
| 4,819,259 | 4/1989 | Tanaka . | |
| 4,891,746 | 1/1990 | Bowman et al. | 363/16 |
| 4,903,181 | 2/1990 | Seidel | 363/16 |

FOREIGN PATENT DOCUMENTS

| | | |
|---|---|---|
| 60-28725 | 2/1985 | Japan . |
| 61-132071 | 6/1986 | Japan . |

OTHER PUBLICATIONS

U.S. Patent application Ser. No. 909,130, filed by Tanaka, entitled "Rotary Anode Type X-Ray Apparatus".

U.S. Patent application Ser. No. 773,208, filed by Tanaka et al., entitled "Voltage-Resonance Type Power Supply Circuit for X-Ray Tube.".

*Primary Examiner*—Edward P. Westin
*Assistant Examiner*—Kim-Kwok Chu
*Attorney, Agent, or Firm*—Finnegan, Henderson, Farabow, Garrett, and Dunner

[57] ABSTRACT

In a voltage generating system for an X-ray diagnosis apparatus, a smoothing filter is arranged between a rectifying circuit connected to an AC power source and a smoothing capacitor. In the smoothing filter, by a switching operation for a current from the rectifying circuit, a power source voltage and a current are of in-phase, and harmonic components included in the current can be eliminated. When a current limiting circuit and a smoothing capacitor are used in place of the smoothing filter, a voltage supplied to a DC-DC converter is set to be constant.

5 Claims, 5 Drawing Sheets

X-RAY GENERATOR COMPRISING SWITCHING VOLTAGE REGULATOR TO REDUCE HARMONIC CURRENT COMPONENTS FOR SUPPLYING CONSTANT POWER

BACKGROUND OF THE INVENTION

1. Field of the Invention

The present invention relates to a method and system for controlling an output in an X-ray apparatus.

2. Description of the Related Art

In an X-ray diagnosis apparatus, in order to radiate an X-ray to an object to be examined, a voltage generating apparatus is used to apply a tube voltage to an X-ray tube. This voltage generating apparatus includes an AC-DC converter for converting an AC voltage into a DC voltage.

As shown in FIG. 1, the AC-DC converter includes an AC power source 1, a rectifying circuit 2, a smoothing capacitor C, and a load resistor RL.

In the rectifying circuit 2, series-connected diodes D1 and D2 are connected in parallel to series-connected diodes D3 and D4. An AC voltage from the AC power source 1 is applied to terminals a and b of the rectifying circuit 2 through a power source resistor re, and the applied voltages are full-wave rectified. Thereafter, the rectified voltages are output through terminals c and d, respectively. An output voltage from the rectifying circuit 2 is smoothed by the capacitor C. A voltage of the capacitor C is applied to the load resistor RL.

Since the capacitor C is directly connected to the rectifying circuit 2, an impedance of the AC-DC converter is nonlinear with respect to a power source voltage of the AC power source 1, and a harmonic current flows into the AC power source 1.

As shown in FIG. 2, since a current i includes an odd-numbered order harmonic component with respect to a power source voltage V of the AC power source 1, the power source voltage V is distorted. If the content of harmonic component is large, a power factor is reduced. Therefore, in order to supply constant power to the load resistor RL, a large-capacitance AC power source must be used.

Power is supplied from the capacitor C to the load resistor RL during an X-ray radiation period. A power E can be obtained as:

$$E=C\cdot(\sqrt{2}e)^2\cdot[1-\{RL/(RL=re)\}^2]/2$$

Therefore, power supplied from the capacitor C to the load resistor RL is determined in accordance with an impedance value of the load resistor RL and the power source resistor re. For example, when $RL/(RL+re)\geqq 0.9$, only about 20% of the total capacitance of the capacitor C can be supplied.

As described above, an X-ray generating apparatus which can improve a power factor by reducing a harmonic component of current, and can efficiently supply power from a capacitor to an X-ray tube is desirable.

SUMMARY OF THE INVENTION

It is an object of the present invention to provide a method and system for controlling an output in an X-ray apparatus.

According to one aspect of the present invention, there is provided a method for controlling an output in an X-ray generating apparatus, the method comprising the steps of:

generating an AC voltage having a desired frequency;

rectifying the generated AC voltage into a rectified signal;

setting a switching frequency;

switching the rectified signal in accordance with the set switching frequency to obtain a plurality of outputs signals;

storing the output signals;

outputting the output signals during a desired period; and generating an X-ray in accordance with the output signals.

According to another aspect of the present invention, there is provided a system for controlling an X-ray generating apparatus, the system comprising:

first generating means for generating an AC voltage having a desired frequency;

rectifying means for rectifying the generated AC voltage to obtain a rectified signal;

setting means for setting a switching frequency;

switching means for switching the rectified signal in accordance with the set switching frequency to obtain a plurality of signals;

first storing said output signals means for storing a fourth output;

outputting means for outputting the stored output signals output during a desired and second generating means for generating an X-ray in accordance with the stored output signals.

DETAILED DESCRIPTION OF THE PREFERRED EMBODIMENTS

Preferred embodiments of the present invention will be described hereinafter with reference to the accompanying drawings.

Figure 1:
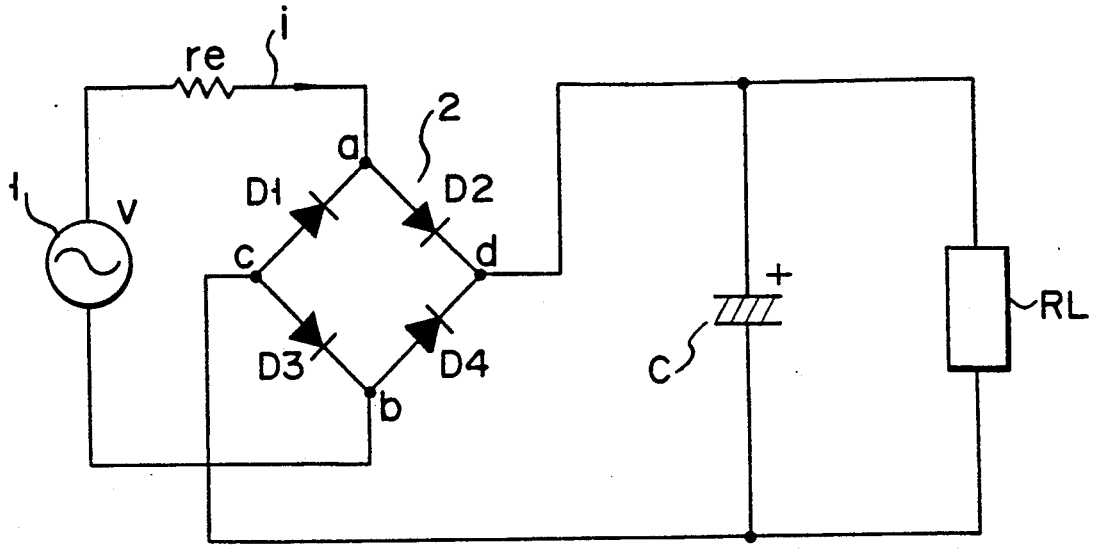
FIG. 1 (PRIOR ART)
FIG. 1 is a circuit diagram showing an arrangement of a conventional AC-DC converter.
Figure 2:
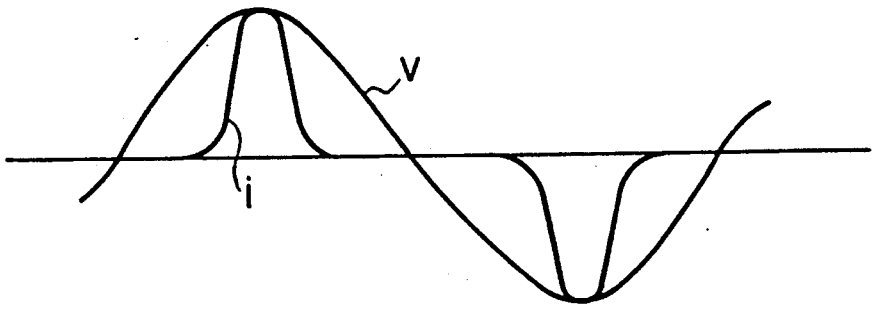
FIG. 2 (PRIOR ART)
FIG. 2 is a waveform chart showing a power source voltage waveform and a current waveform including a harmonic component flowing into an AC power source in the AC-DC converter shown in FIG. 1.
Figure 3:
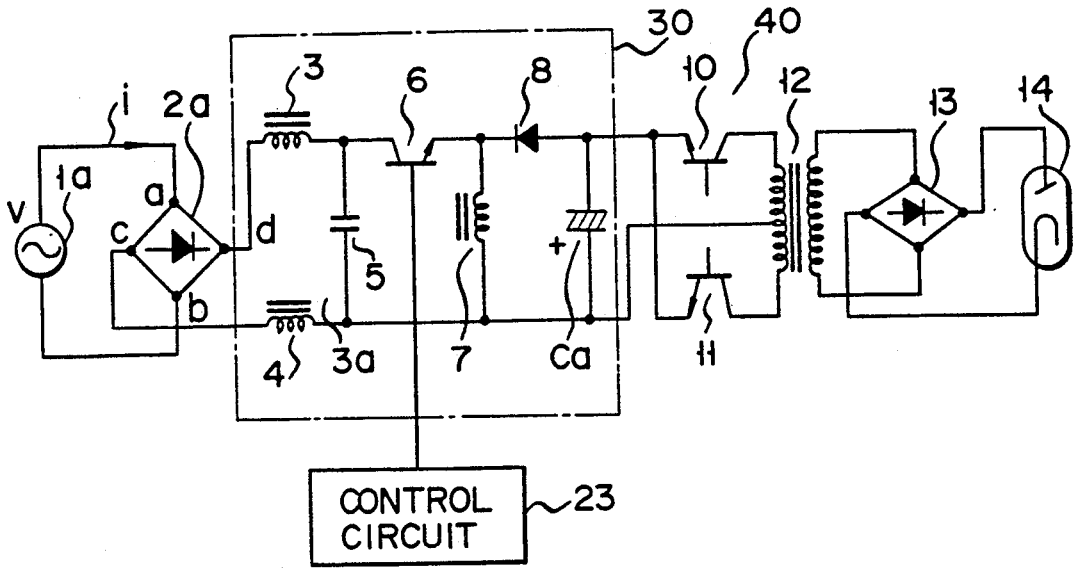
FIG. 3 is a circuit diagram showing an arrangement of a system according to a first embodiment of the present invention.

Referring to FIG. 3, a system according to a first embodiment includes an AC power source 1a, a rectifying circuit 2a, an active smoothing filter 30, an inverter 40, a transformer 12, a rectifying circuit 13, and an X-ray tube 14.

The active smoothing filter 30 includes a low-pass filter 3a, a transistor 6, a choke coil 7, a diode 8, and a capacitor Ca.

The low-pass filter 3a includes a choke coil 3 having one terminal connected to a terminal d of the rectifying circuit 2a, a choke coil 4 having one terminal connected to a terminal c, and a capacitor 5 connected to the other terminal of each of the choke coils 3 and 4. Harmonic components of currents switched by the transistor 6 is made not to flow into the AC power source 1a.

The collector of the transistor 6 is connected to a node of the choke coil 3 and the capacitor 5. A control signal is input from a control circuit 23 to the base of the transistor 6 so that the transistor 6 performs an ON/-OFF operation at a sufficiently higher frequency than a frequency of the AC power source 1a. Therefore, a signal having a pulse waveform is output from the low-pass filter 3a.

One terminal of the choke coil 7 is connected to a node between the capacitor 5 and the choke coil 4, and the other terminal thereof is connected to the emitter of the transistor 6. The cathode of the diode 8 is connected to a node between the choke coil 7 and the emitter of the transistor 6, and the anode of the diode 8 is connected to one terminal of the capacitor Ca. Current of the choke coil 7 is supplied to the capacitor Ca while the transistor 6 is OFF, and the capacitor Ca is charged by the supplied current.

The inverter 40 including transistors 10 and 11 converts a DC voltage from the filter 30 into an AC voltage, and outputs the AC voltage to the transformer 12. In the rectifying circuit 13, an AC voltage from the transformer 12 is rectified, and the rectified voltage is applied to the X-ray tube.

An operation of the system according to he first embodiment will be described hereinafter.

An AC voltage supplied from the AC power source 1a is rectified by the rectifying circuit 2a, and the rectified voltage is applied to the transistor 6 through the low-pass filter 3a. At this time, the transistor 6 performs a switching operation.

When the transistor 6 is turned on in response to the control signal input to the base, a collector current I flowing into the collector is defined as:

$$I=(E\times t)/L \quad (1)$$

where E is a voltage of the capacitor 5, L is an inductance of the coil 7, and t is a time elapsed after the transistor 6 is turned on. Note that the diode 8 is in a reverse-biased state during an ON period of the transistor 6.

Figure 4:
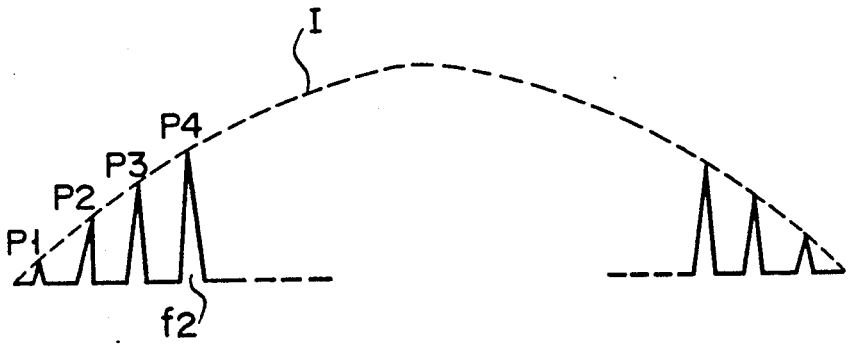
FIG. 4 shows an emitter waveform of a transistor in the system according to first embodiment.
Figure 5:
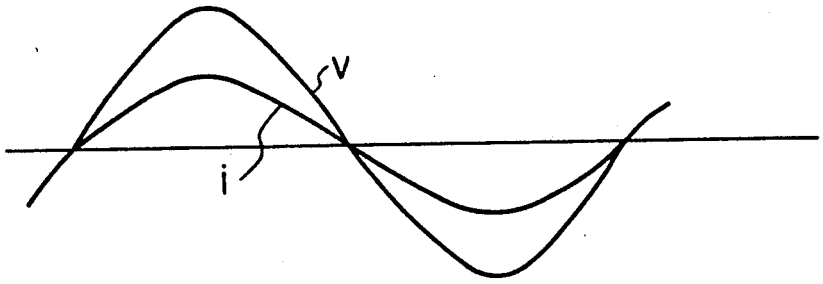
FIG. 5 shows a power source voltage waveform and a current waveform flowing into an AC power source in a system according to a first embodiment.

Since a switching frequency f2 of the transistor 6 is very high in comparison with a frequency f1 of the AC power source 1a (e.g., 1,000 times), a voltage of the capacitor 5 can be assumed to be substantially constant as the transistor is turned on and off one time. If the ON period of the transistor 6 is constant, an envelope which connects peaks P1, P2, . . . of the collector current I of the transistor 6 is shown in FIG. 4. As the collector current I of the transistor 6 is averaged by the low pass filter 3a, a current i and the L power source voltage v of the AC power source 1a have in-phase sine waveforms, as shown in FIG. 5.

During an OFF period of the transistor 6, current of the choke coil 7 is supplied to the capacitor Ca. A voltage of the capacitor Ca is converted into an AC voltage by the inverter 40 including the transistors 10 and 11. An AC voltage from the inverter 40 is boosted by the transformer 12, and is rectified by the rectifying circuit 13. Thereafter, the rectified voltage is applied to the X-ray tube 14.

Thus, since the rectifying circuit 2a is not directly connected to the capacitor Ca, an impedance of the circuit is linear with respect to the power source voltage, and harmonic components included in the current i can be largely eliminated. Therefore, a power factor of the system is set to be substantially "1", and hence a small-sized AC power source can be used.

A system according to the second embodiment will be described hereinafter.

Figure 6:
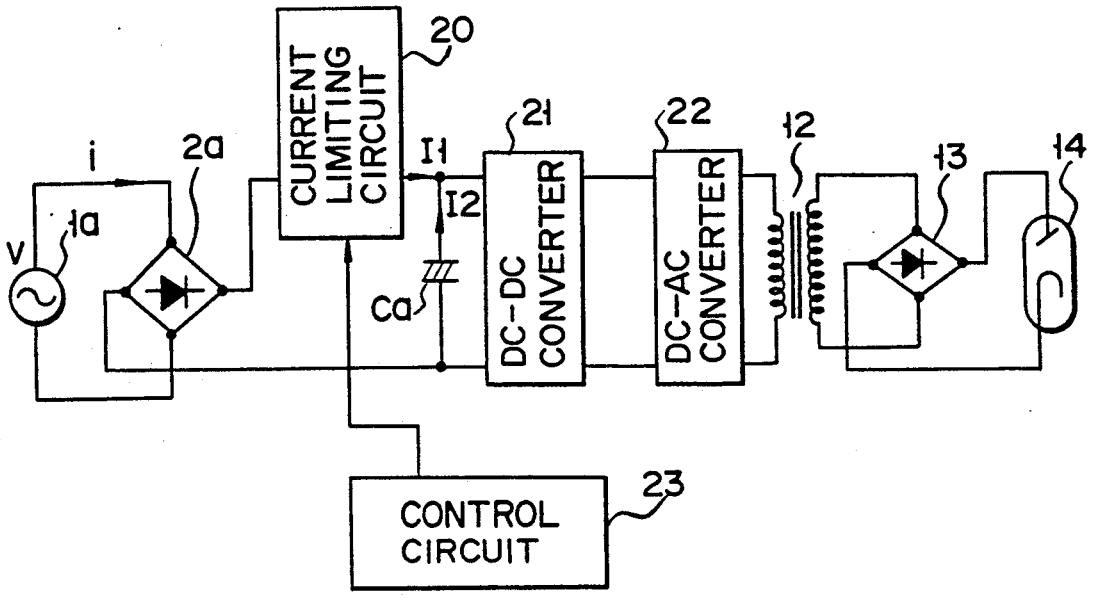
FIG. 6 is a circuit diagram showing an arrangement of a system according to a second embodiment.

As shown in FIG. 6, the system according to the second embodiment includes an AC power source 1a, a rectifying circuit 2a, a current limiting circuit 20, a DC-DC converter 21, a DC-AC converter 22, a control circuit 23, a smoothing capacitor Ca, a transformer 12, a rectifying circuit 13, and an X-ray tube 14.

The current limiting circuit 20 is constituted by, e.g., a rheostat to limit a current input from the rectifying circuit 2a.

The DC-DC converter 21 boosts the voltage of the capacitor Ca to keep an output voltage constantly if the voltage of the capacitor Ca is reduced.

The DC-AC converter 22 converts a DC voltage from the DC-DC converter 21 into an AC voltage.

The control circuit 23 controls the current limiting circuit 20 to compensate the lack of power supplied from the capacitor Ca.

Figure 7:
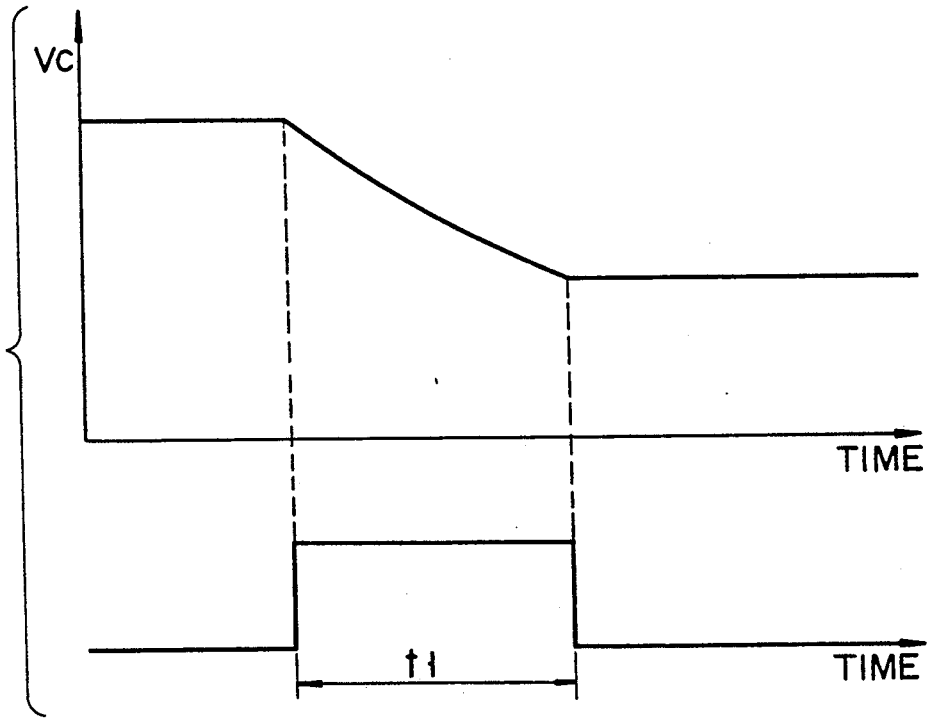
FIG. 7 is a graph showing a change in voltage of a smoothing capacitor during an X-ray radiation period in a system according to a second embodiment.

A voltage supplied from the AC power source 1a is rectified by the rectifying circuit 2a. When the current limiting circuit 20 is controlled in response to a control signal from the control circuit 23, a voltage from the rectifying circuit 2a is limited during an X-ray radiation period t1 in FIG. 7. More specifically, currents I1 and I2 respectively supplied from the current limiting circuit 20 and the capacitor Ca are input to the DC-DC converter 21. Note that when the current I2 is input from the capacitor Ca to the DC-DC converter 21, a voltage Vc of the capacitor Ca is reduced during an X-ray radiation period.

When an X-ray is radiated, a voltage of the capacitor Ca is boosted by the DC-DC converter 21, and the boosted voltage is converted into an AC voltage by the DC-AC converter 22. Thereafter, the AC voltage is applied to the boosting transformer 12. The voltage applied to the transformer 12 is rectified by the rectifying circuit 13, and is applied to the X-ray tube 14.

When a discharging operation is performed to obtain a voltage which is ½ a voltage e of the capacitor Ca, energy E supplied from the capacitor Ca is represented as:

$$E=\{C\cdot(\sqrt{2}e)^2\cdot(1-0.5^2)\}/2=0.75Ce^2 \quad (2)$$

Therefore, 75% of the total energy of the capacitor Ca is supplied to the DC-DC converter 21.

For example, when an X-ray is radiated under the conditions of 100 (KV), 320 (mA), and 0.1 (sec), the power E of 32 (KW) is required. In the capacitor Ca, however, the voltage e is 200 (V), and the capacitance C is 56,000 (μF), the energy E is 0.75 $Ce^2$ = 1,680 (J). In other words, power of 16.8 (KW) can be supplied from the capacitor Ca for 0.1 (sec). The power supplied from the power source is about half in comparison with the conventional apparatus.

Figure 8:
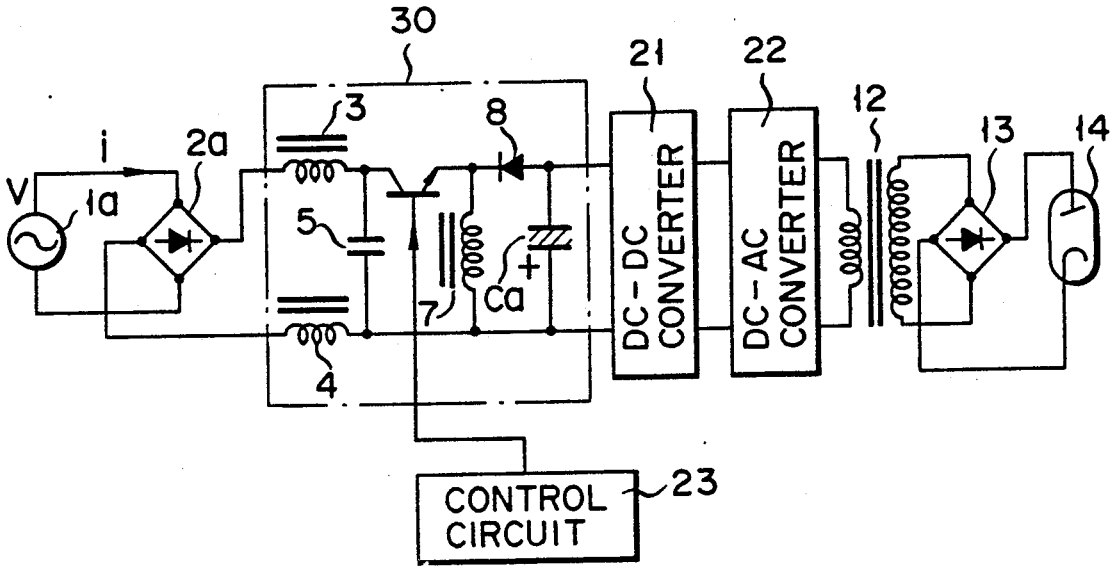
FIG. 8 is a circuit diagram showing an arrangement of a system according to a third embodiment.
Figure 9:
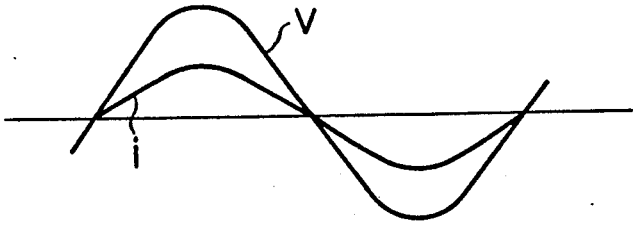
FIG. 9 shows a power source waveform and a current waveform flowing into an AC power source in a system according to a third embodiment.

In a system according to the third embodiment shown in FIG. 8, the active smoothing filter 30 shown in FIG. 3 is used in place of the current limiting circuit 20 and the capacitor Ca in FIG. 6. As shown in FIG. 9, a current i and a source voltage V of an AC power source 1*a* have in-phase sine waveforms by using the active smoothing filter 30. Therefore, a power factor can be greatly increased. As the active smoothing filter 30 has a function for limiting a current flowing into the capacitor Ca from the rectifying circuit 2*a*, the energy of the capacitor Ca can be efficiently taken out during an X-ray radiation period. Therefore, an X-ray generating apparatus can be provided which outputs a high voltage than a voltage by a power capacity of the AC power source 1*a*.

Figure 10A:
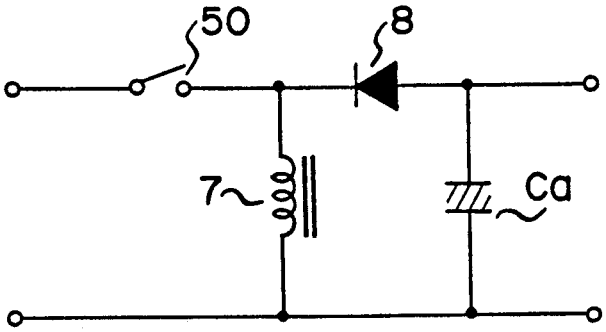
FIGS. 10A to 10D are circuit diagrams showing different arrangements of a smoothing filter in the above embodiments.
Figure 10B:
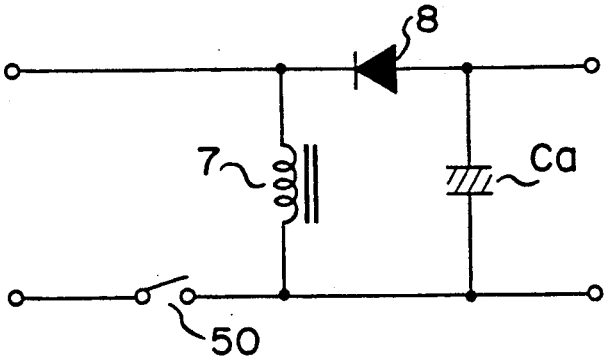
Figure 10C:
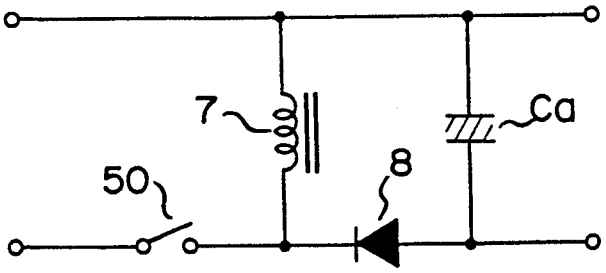
Figure 10D:
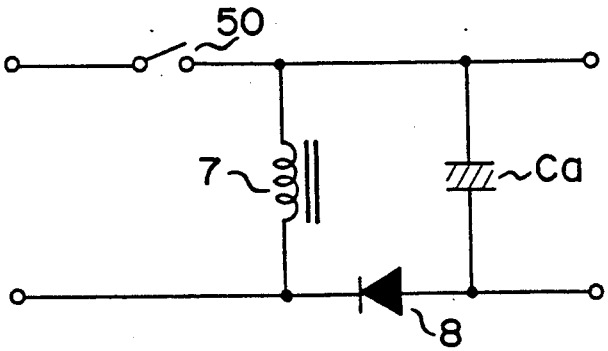

Note that in addition to a circuit arrangement in FIG. 10A used in this embodiment, circuit arrangements shown in FIGS. 10B, 10C, and 10D allow the same operation in an active smoothing filter 30 as in the above embodiments.

Although the bipolar transistor 6 is used as a switching element in the above embodiments, e.g., a MOSFET or an IGBT can be used.

According to the present invention, since a rectifying circuit is not directly connected to a capacitor by using an active smoothing filter, an impedance of the circuit is linear with respect to a power source voltage, and a current and a voltage have in-phase wave forms. Therefore, harmonic components included in the current can be largely eliminated, and a power factor of the system can be set substantially "1". As the energy of the capacitor can be efficiently taken out, an X-ray generating apparatus can be provided which outputs a high voltage than a voltage by a power capacity of the AC power source.

Although the embodiments of the present invention have been described above, the present invention is not limited to the above embodiments, and various changes and modifications can be made within the spirit and scope of the invention.

What is claimed is:

1. An X-ray controlling apparatus comprising:

a AC power source;

a rectifying circuit having two circuit terminals for rectifying an output from the power source;

a first coil;

a second coil;

a first capacitor having two first capacitor terminals, one first capacitor terminal connected to one circuit terminal through the first coil, the other first capacitor terminal connected to the other circuit terminal through the second coil;

a switch;

a third coil having two coil terminals, one coil terminal connected to the one first capacitor terminal through the switch, the other coil terminal connected to the other first capacitor terminal;

a second capacitor having two second capacitor terminals, one second capacitor terminal connected to the one coil terminal of the third coil, the other second capacitor terminal connected to the other coil terminal of the third coil;

a diode having anode and cathode terminals of the third coil, the cathode arranged between the one coil terminal of the third coil and the one second capacitor terminal, the anode terminal connected to the one second capacitor terminal, the cathode terminal connected to the one coil terminal of the third coil; and generating means connected to the two second capacitor terminals for generating an X-ray.

2. A system for controlling an X-ray generating apparatus, the system comprising:

an AC power source providing an output voltage having a predetermined first frequency;

a rectifying circuit for rectifying the output voltage from said AC power source;

a low pass filtering circuit for passing a current having a frequency component less than said first frequency of said output voltage from said AC power source;

a switching circuit for chopping the current supplied from said low pass filter circuit at a second frequency higher than said first frequency;

a choke coil having terminals connected to said switching circuit, for storing a current from said switching circuit;

a capacitor connected to one terminal of said choke coil for smoothing current supplied from said choke coil while the switching circuit is off;

means connected to said capacitor and said choke coil for disconnecting said capacitor from said AC power source; and generating means connected to said capacitor terminals for generating X-rays.

3. The system according to claim 2, wherein said generating means comprises:

an inverter circuit for converting a smoothed DC voltage from the capacitor into an AC voltage;

a transformer having primary and secondary windings, the primary winding being connected to said inverter circuit for generating a high voltage on the secondary winding;

a high voltage rectifying circuit for rectifying the high voltage from said transformer; and an X-ray tube connected to said high voltage rectifying circuit for generating an X-ray beam.

4. The system according to claim 2, wherein the second frequency of the switching circuit is 1000 times said first frequency.

5. The system according to claim 2, wherein said means for disconnecting said capacitor from said AC power source comprises a diode.

* * * * *